US005932077A

United States Patent [19]

Reynolds

[11] Patent Number: 5,932,077

[45] Date of Patent: Aug. 3, 1999

[54] PLATING CELL WITH HORIZONTAL PRODUCT LOAD MECHANISM

[75] Inventor: H. Vincent Reynolds, Marcellus, N.Y.

[73] Assignee: Reynolds Tech Fabricators, Inc., East Syracuse, N.Y.

[21] Appl. No.: 09/020,832

[22] Filed: Feb. 9, 1998

[51] Int. Cl.[6] ..... C25D 17/00

[52] U.S. Cl. ..... 204/224 R; 204/273; 204/283; 204/297 R; 204/DIG. 7; 427/430.1; 427/437; 118/429; 118/500

[58] Field of Search ..... 204/273, 283, 204/297 R, DIG. 7, 224 R; 427/430.1, 437, 443.1; 118/404, 407, 421, 428, 429, 423, 500

[56] References Cited

U.S. PATENT DOCUMENTS

| | | | |
|---|---|---|---|
| 3,907,649 | 9/1975 | Becker | 204/224 R |
| 4,081,347 | 3/1978 | Becker | 204/224 R |
| 4,447,306 | 5/1984 | Ushio et al. | 204/224 R |
| 5,597,460 | 1/1997 | Reynolds | 204/212 |
| 5,683,564 | 11/1997 | Reynolds | 205/68 |
| 5,865,894 | 2/1999 | Reynolds | 118/429 |

*Primary Examiner*—Kathryn Gorgos
*Assistant Examiner*—Wesley A. Nicolas
*Attorney, Agent, or Firm*—Trapani & Molldrem

[57] ABSTRACT

A wet process apparatus, e.g., plating cell for plating a flat substrate introduces a flow of electrolyte or other plating solution across the surface of the substrate to be plated. The substrate is mounted on a holder that is positioned on a door that swings between a horizontal open position and a vertical closed position. There is a circular opening in a front wall against which the door seats. The door can have a sealing ring that contacts the wall of the cell outside of the opening. A cathode ring disposed in a recess in the periphery of the opening makes electrical contact with the substrate. The cathode ring can include a thin metal thieving ring. A fluid-powered rotary blade or wiper within the plating chamber rotates to draw bubbles or other impurities from the substrate, and a megasonic transducer applies megasonic acoustic energy to the solution, e.g., at 0.2 to 5 Mhz. The cell can be used for electroless or galvanic plating.

7 Claims, 3 Drawing Sheets

PLATING CELL WITH HORIZONTAL PRODUCT LOAD MECHANISM

BACKGROUND OF THE INVENTION

This invention relates to wet process plating cells, either galvanic (for electroplating) or electroless (chemical plating), and is more particularly directed to a technique that permits the rapid insertion and removal of the workpiece to be plated into and from the cell. The invention also concerns a technique that facilitates employment of robotic means for transfer between stations of the articles to be plated.

Electroplating plays a significant role in the production of many rather sophisticated technology products, such as masters and stampers for use in producing digital compact discs or in the manufacturing of advanced semiconductor wafers. However, as these products have become more and more sophisticated, the tolerances of the plating process have become narrower and narrower. For example, in a modern CD, impurities or blemishes of 0.3 micron or larger can create unacceptable data losses. Current electroplating techniques can result in block error rates of 70, and with higher density recordings, the block error rate can be 90 or higher. Current plans to increase the circuit density of silicon wafers are being thwarted by the inability of plating techniques to control blemishes in the plating process.

A number of techniques for electro-depositing or coating on an article face been described in the patent literature, but it has been difficult to achieve the high plating purity and evenness of application that are required for super-high density optical media and semiconductor devices.

A recent technique that employs a laminar flow sparger or injection nozzle within the plating bath is described in my recent U.S. Pat. No. 5,597,460, granted Jan. 28, 1997. The means described there achieve an even, laminar flow across the face of the substrate during the plating operation. A backwash technique carries the sludge and particulate impurities away from the article to be plated, and produces a flat plated article of high tolerance, such as a high-density compact disc master or semiconductor wafer.

In the manufacture of compact discs, there is a step that involves the use of a so-called stamper. The stampers are negative discs that are pressed against the material for the final discs to create an impression that becomes the pattern of tracks in the product compact discs.

Stampers are nickel and are electroformed. The stampers are deposited on a substrate that has the data tracks formed on it, and has been provided with a conductive surface, e.g., by sputter coating. Then the substrate is placed into a plating tank. The nickel is introduced in solution into the process cell so that it can be electrochemically adhered onto the substrate surface, using standard electroplating principles. Present industry standards require the stamper to have an extremely high degree of flatness, and where higher density storage is to be achieved, the flatness tolerance for the nickel coating becomes narrower and narrower.

The flow regime for the plating solution within the tank or cell is crucial for successful operation. Flow regime is affected by such factors as tank design, fluid movement within the process vessel, distribution of fluid within the vessel and at the zone of introduction of the solution into the vessel, and the uniformity of flow of the fluid as it is contacts and flows across the substrate in the plating cell.

Present day electroplating cells employ a simple technique to inject fluid into the process vessel or cell. Usually, a simple pipe or tube is used with an open end that supplies the solution into the tank or cell. The solution is forced from the open end of the pipe. This technique is not conducive to producing a flat coating, due to the fact that the liquid is not uniformly distributed across the surface of the workpiece. This technique can create high points and low points in the resulting plated layer, because of localized eddies and turbulences in the flow regime.

In the plating cell as described in said U.S. Pat. No. 5,597,460, a plating bath contains the electrolyte or plating solution, in which the substrate to be plated is submerged in the solution. A sparger or equivalent injection means introduces the solution into the plating bath and forms a laminar flow of the electrolyte or plating solution across the surface of the substrate to be plated. Adjacent the plating bath is an anode chamber in which anode material is disposed, with the material being contained within an anode basket. In a typical optical media or semiconductor electrolytic metallization process, the anode material is in the form of pellets, chunks or nuggets of metal, which are consumed during the plating process. A weir separates the plating bath from the anode chamber, and permits the plating solution to spill over its top edge from the plating bath into the anode chamber. The weir is in the form of a semipermeable barrier that permits metal ions to pass through from the anode chamber into the plating bath, but blocks passage of any particulate matter. A circulation system is coupled to the drain outlet to draw off the solution from the anode chamber, together with any entrained particles, and to feed the solution through a microfilter so that all the particles of microscopic size or greater are removed from the plating solution. Then the filtered solution is returned to the sparger and is re-introduced into the plating cell. In this way a backwash of the plating solution is effected, so that the flow regime of the fluid itself washes any particulates out of the anode chamber in the direction away from the plated article. At the same time, the cleansed and purified solution bathes the plated surface of the substrate as a uniform, laminar flow of solution, thus avoiding high spots or voids during plating. As a result, very high tolerance is achieved, permitting production of compact disc or semiconductor device of extreme density without significant error rates.

The flow regime as described in said U.S. Pat. No. 5,597,460 is further improved by the geometry of the well that forms the tank for the plating bath. In that patent the substrate can be positioned on either a fixed or a conventional rotary mount. A conventional cathodic motor rotates the substrate, e.g. at 45–50 RPM. The substrate can be oriented anywhere from vertical to about 45 degrees from vertical. The well has a cylindrical wall that is coaxial with the axis of the substrate. This arrangement was intended to avoid corners and dead spaces in the plating cell, where either the rotation of the substrate or the flowing movement of the plating solution might otherwise create turbulences.

A U-tube laminar flow sparger, shaped to fit on the lower wall of the plating bath or plating cell, can be positioned adjacent the base of the weir to flow the solution into the space defined between the substrate and the weir. The sparger's flow holes are directed in parallel to create a uniform, laminar flow of the electrolyte across the planar face of the substrate. The axes of the flow holes in the sparger define the flow direction of the plating solution, i.e., generally upwards and parallel to the face of the plated substrate.

Unfortunately, even with these improvements, the plating is not completely even over the substrate. There is a tendency for hydrogen bubbles to accumulate on the surface of the substrate where electrolytic plating is taking place, and these can interfere with the plating and cause errors in the metallized wafer. Also, with conventional plating there is a tendency for the plated surface to become bowed out, that is, for the plated metal layer to lose its flatness away from the center. Consequently, it was necessary to plate a large margin around the targeted substrate or stamper, so that center part will have the desired flatness. This necessitated using additional time and materials.

An improvement to this arrangement is described and illustrated in my earlier U.S. Pat. No. 5,683,564, which was granted on Nov. 4, 1997, which is incorporated herein by reference. According to that improvement, a rotary blade or wiper is positioned in the plating bath between the semipermeable membrane wall and the substrate, and has an edge disposed a predetermined distance from the planar face of the substrate. This distance can be about one-half inch, and is preferably about three-eighths inch. Preferably, the blade or wiper is pitched in the direction such that the rotating wiper tends to pull the electrolyte, plus any hydrogen bubbles, away from the substrate. The rotary wiper can be fluid powered, and as such can be coupled to the electrolyte return conduit so that the electrolyte itself serves as motive power. The fluid powered wiper can be formed with an annular turbine, mounted in a circular mount therefor that is disposed in the plating bath. A circular opening is in registry with the substrate face that is to be plated. The blade on the annular turbine extends radially inwards. The turbine can have vanes around its periphery, and the circular mount can have an annular recess around which the vanes travel. A conduit from the return conduit to the annular recess supplies fluid to propel the turbine and vane. As the same filtered and conditioned electrolyte that is fed through the sparger into the plating bath is also used to power the turbine, the leakage from this turbine does not in any way contaminate or dilute the electrolyte in the plating bath. The same materials that are used in the walls of the plating cell, e.g., a high quality polypropylene or PFA TEFLON® (polytetrafluoroethylene), are also used for the rotary blade, turbine, and mount. The annular turbine can be supported for rotation by rollers (formed of the same or a compatible plastic resin) mounted on the support for the annular turbine. This avoids the need for any bearings or metallic parts. In other possible implementations, a different motor mechanism could be employed to rotate the blade or wiper.

Electroless plating is favored in many applications, and especially in those where there is no electrically conductive layer that could serve as a cathode. Accordingly, electroless plating is now seen as an economical alternative to sputtering or vacuum deposition.

One advantageous approach to electroless plating is disclosed in my U.S. Pat. No. 5,865,894, which was granted on Feb. 2, 1999, which is incorporated herein by reference. In that arrangement, a megasonic transducer adjacent the floor of the plating cell applies megasonic energy at a frequency of about 0.2 to 5 MHz to the solution. The frequency can be above 1 MHz, and in some cases above 5 MHz. The megasonic waves distribute the solution evenly on the substrate, and also break up any bubbles or concentrations that may lead to defects in the plated surface.

Where the megasonic plating technique is used for electroplating silicon wafers, the flow regime is further improved by rotating the wafers. This can be achieved by placing the wafers in a carrier or boat and rotating the boat, e.g. at 45–50 RPM. This avoids regions of dead flow within the carrier, and results in uniformity of the metallization thickness and quality.

In order to employ the megasonic plating technique with a stationary substrate, the megasonic transducer and the rotary blade can be incorporated together in a plating cell, as described and illustrated in my U.S. patent application Ser. No. 08/954,239, which was filed on Oct. 20, 1997, is still pending and has been incorporated herein by reference.

To date, mounting the substrate and lowering the substrate into the plating cell have had to be done manually, and have not been automated or robotized. Automation and robotization of the insertion, removal, and transport of the workpiece from one process cell to another have been elusive and have not been realized. This has made it difficult to conduct the entire multiple step plating operation in a clean or superclean environment.

OBJECT AND SUMMARY OF THE INVENTION

Accordingly, it is an object of this invention to provide a plating cell which is simple and compact in design, and which avoids the drawbacks of the prior art.

It is another object of this invention to provide a plating cell which facilitates insertion and removal of the substrate or other workpiece into and from the plating cell.

It is a further object to provide a plating cell suitable for either galvanic plating or electroless plating, and which can be automated as to the loading or unloading of the workpiece.

According to one aspect of the present invention, a planar face of a substrate is plated with a metal layer. A plating chamber contains an electrolyte or electroless plating system in which the substrate is immersed. A sparger introduces the plating fluid into the plating compartment. A weir permits the plating fluid to spill over from the bath into a second chamber, from which it passes to fluid processing equipment, and then is returned to the sparger. The weir can have a semipermeable membrane wall that permits ions to pass through from the second chamber into said plating chamber, but blocks the flow of the the plating fluid and any entrained particulates. A rotary blade or wiper is positioned in the plating chamber between the semipermeable membrane wall and the substrate, and has an edge disposed a predetermined distance from the planar face of the substrate. Preferably, the blade or wiper is pitched in the direction such that the rotating wiper tends to pull the plating fluid, plus any bubbles or impurities away from the substrate. The rotary wiper is preferably fluid powered.

A megasonic transducer can be incorporated in acoustic communication with the plating chamber.

The arrangement of this invention incorporates the improvement in which the carrier for the substrate is disposed on a sealable door for the plating cell. The door opens to a loading position, which is preferably the horizontal position, and closes to a position which preferably holds the substrate vertically in the plating chamber. The door sealably seats onto an opening in a side wall of the cell. An extendible linear actuator, or other equivalent device, can be employed for moving the door between its open and closed positions. The cell favorably incorporates a controllable drain that opens to drain the solution from the cell so that the same is at a level below the door opening when the door is opened, and which closes to permit the cell to be flooded to the lever of the spillover when the door is in its closed position. For electroplating use, a cathode ring is disposed at the periphery of the door opening for making electrical contact with the substrate when the door is closed. This cathode ring may include a so-called "thieving ring" that extends radially into contact with the substrate.

The above and many other objects, features, and advantages of this invention will become more fully appreciated from the ensuing detailed description of a preferred embodiment, which is to be considered in conjunction with the accompanying Drawing.

DETAILED DESCRIPTION OF THE PREFERRED EMBODIMENT

The process flow circuit can be generally configured as shown in my U.S. Pat. No. 5,597,460, which is incorporated herein by reference. As in that arrangement, the plating solution enters via a sparger into a first or plating chamber, backwashes into a second chamber, and exits the second chamber to filters, pumps, and a reservoir, where the plating solution temperature and other parameters are adjusted as necessary. Then the solution is fed back to the sparger.

Figure 1:
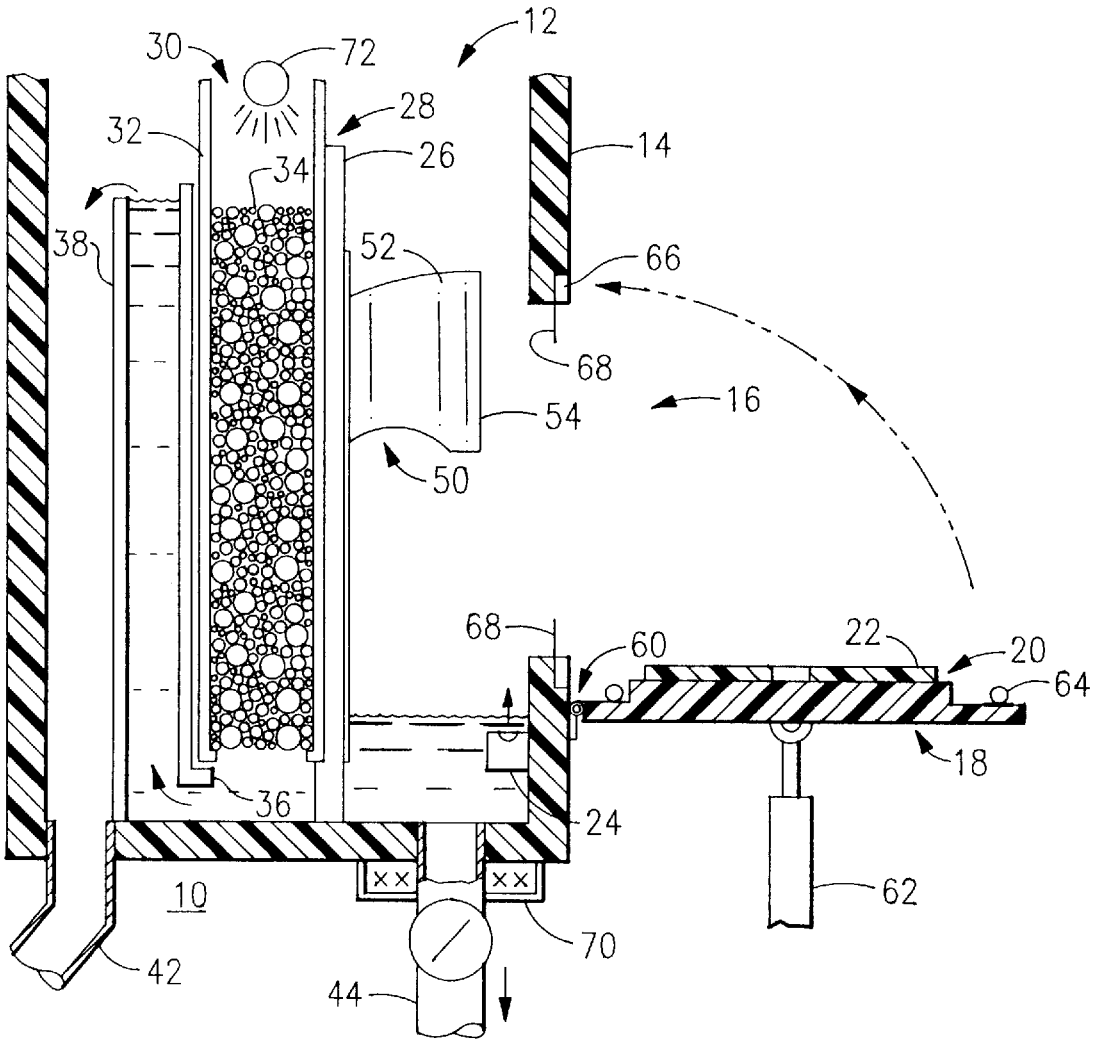
FIG. 1 is a cross sectional elevation of a plating cell according to one preferred embodiment of this invention, showing the door in its open position.
Figure 2:
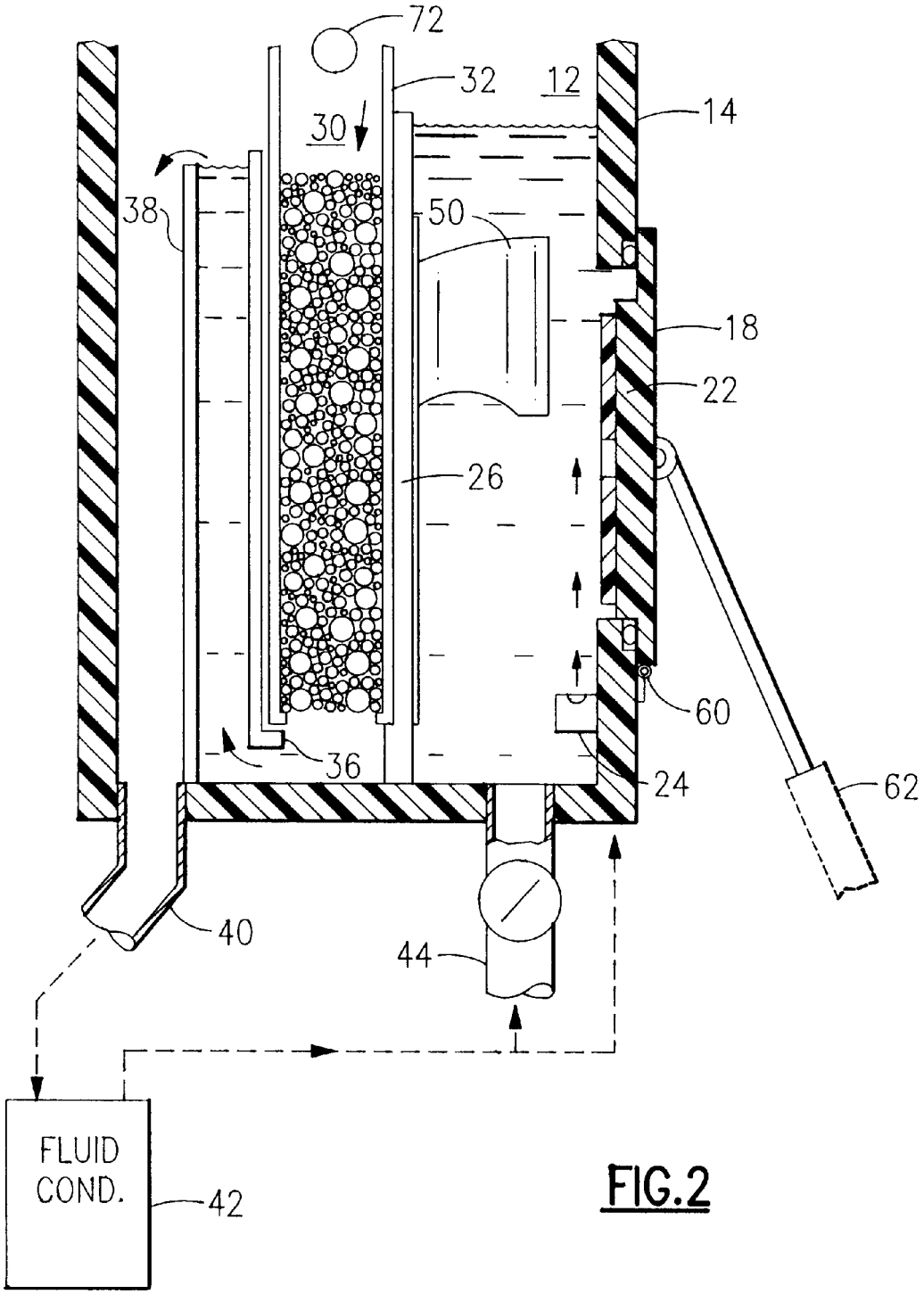
FIG. 2 is a cross sectional elevation showing the door in its closed position.

An improved electroplating cell 10 according to an embodiment of this invention is illustrated in FIGS. 1 and 2. Here plating cell 10 is of generally rectangular shape, with a plating or cathode chamber 12 adjacent a vertical front wall 14. The front wall 14 has a circular opening 16 onto which is fitted a hinged door 18. A plate holder 20 is affixed to a fluid side of the door 18 and holds a substrate 22, here in the form of a glass plate is etched with digital tracks and covered with a conductive coating, e.g., by sputtering or by electroless plating, is fitted into the plate holder 20 and serves as the cathode.

A sparger 24 is in the form of a U-shaped member having a series of flow holes for producing a vertical non-turbulent flow of electrolyte. The sparger 24 is disposed at a lower part of the cathode chamber 12. On the side of the chamber 12 away from the door 18 is a weir 26, in the form of a generally vertical wall having a circular opening that is situated generally in registry with the substrate 20. There is a semi-permeable membrane (not shown) across the opening to permit metal ions dissolved in the electrolyte to pass, but which blocks the flow of the liquid electrolyte. At the top edge of the weir 26 is a spillway 28, here of a sawtooth design, which facilitates flow of the electrolyte over the weir 26 into an anode chamber 30. The serrations on the spillway 28 reduce the surface tension drag, both improving the cascading and also minimizing leveling procedures during installation. The anode chamber 30 contains an anode basket 32 containing a fill of metal pellets 34 (e.g., Ni, Cu, Sn or other metal) which are consumed during the plating process. The process fluid washes over the pellets in the anode basket 32, and then proceeds around an anode basket locating plate 36 (behind the basket 32). The electrolyte then flows over an anode chamber leveling weir 38, and proceeds out a main process drain 40. The electrolyte thence continues to the equipment 42 within an equipment cabinet, where it is filtered and treated before being returned through the return conduit to the sparger 24. Also shown at the base of the cathode chamber 12 is a cathode chamber dump drain 44. This drain 44 is normally kept closed during a plating process, but is opened after the plating process to empty the cathode chamber, as will be discussed shortly.

Also shown in FIGS. 1 and 2 is a rotary wiper or blade unit 50 fitted against the weir 26. The wiper has a curved blade 52 that extends generally proximally towards the substrate and has a generally linear radial edge 54 that is positioned a short distance from the substrate 22. This distance should be less than one inch, preferably below a half inch, and in this embodiment this distance is about three-eighths inch. The blade 52 can be unitarily formed onto an annular turbine member or ring member. This rotary wiper arrangement is described in detail in U.S. Pat. No. 5,683,564. The blade is curved in relation to the direction of rotation so that it draws fluid away from the substrate 22, that is, in the distal direction, towards the anode.

The door 18 is configured so that it can swing down to an open position, as shown in FIG. 1, or swing up to a closed position, as shown in FIG. 2. A hinge or pivot 60 is disposed at a lower part of the door, and closing means, e.g., a linear actuator 62 or equivalent door closing means is provided for moving the door between its open and closed positions. An annular seal 64 is positioned on the door 18 to seal against the wall 14. A cathode ring 66 is positioned in a recess on the periphery of the opening 16 so as to contact the substrate 22 when the door 18 is moved to its closed position. A thin metal "thieving" ring 68 is positioned on the cathode ring 66 to contact the periphery of the substrate 22 and absorb some of the unevenness or buildup that is typically found at the outer edge of an electroplated substrate.

Also shown in this embodiment is a megasonic transducer 70 in acoustic communication with the chamber 12, and generating megasonic energy, e.g. in the range of several hundred kilohertz to several megahertz. Another feature shown here is a sprinkler 72, which sprays fluid into the chamber 30, when the door 18 is in its opened position, at a rate so as to accommodate seepage through the semipermeable membrane in the weir 26, as discussed shortly.

Between plating operations, the door 18 is lowered to its open position, as shown in FIG. 1, and the substrate 22 is exposed in a horizontal, face-up position. This readies the same to be picked up by a robotic or other automated system and moved to another station. Then a fresh substrate 22 can be moved into position on the holder 20. After this, the door 18 is moved to its closed position (FIG. 2), and a plating operation is conducted. During plating, the plating solution is fed through the sparger 24 into the cathode chamber 12, and the latter is kept full so that the fluid spills over the spillway 28 of the weir 26, and continues in the fluid pathway to the anode chamber drain 42. When the plating of the substrate 22 is complete, the electric current is switched off, and the drain 44 is opened to drain the fluid from the cathode chamber 12, down to a level below the base of the door opening 16. At this time there is a minor, but continuous seepage of the solution through the semipermeable membrane in the weir 26. To replace this fluid in the chamber 30, a similar flow of fluid is provided to the sprinkler 72, to maintain fresh solution in the anode chamber at the level of the anode chamber leveling weir 38. Then, when the holder 20 is reloaded and the door 18 is moved to its closed position (FIG. 2) the cathode chamber is again flooded, and the current is switched back on.

Figure 3:
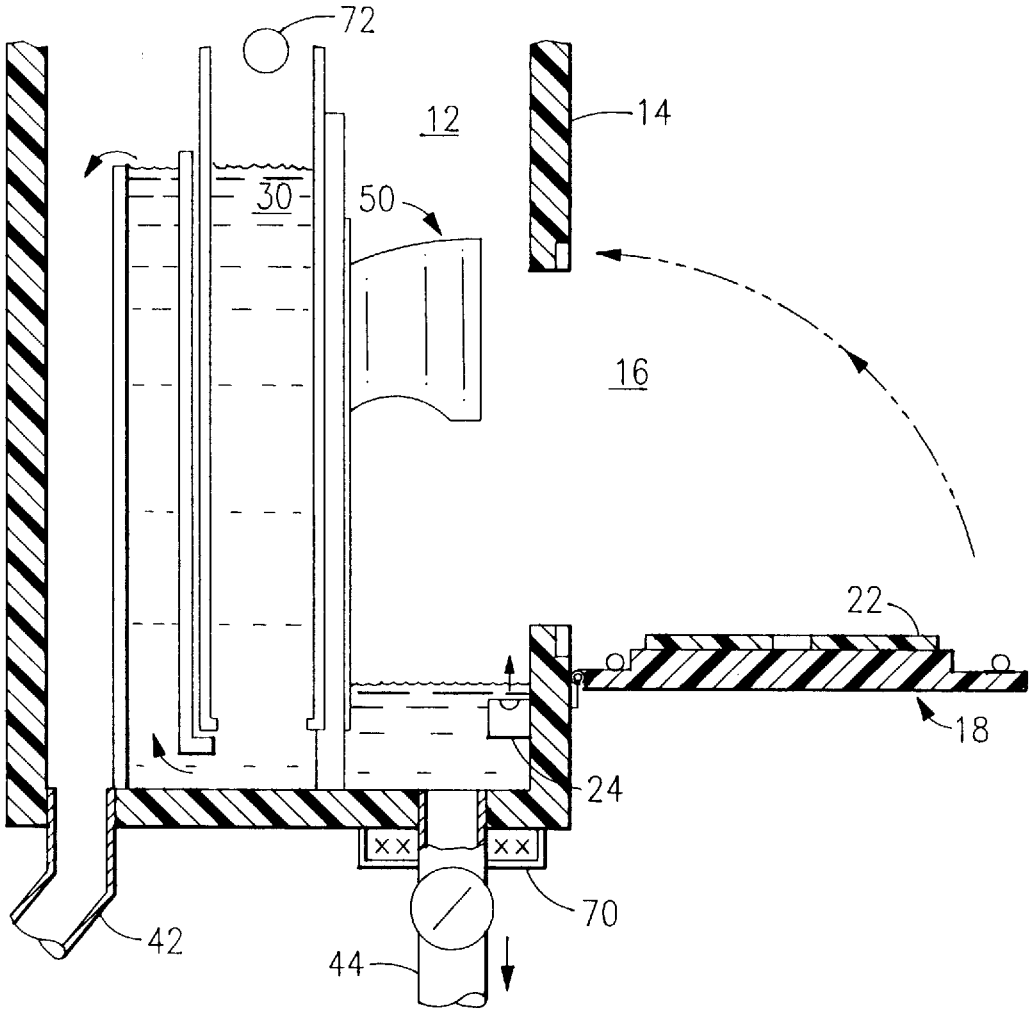
FIG. 3 is a cross sectional elevation of another embodiment.

FIG. 3 shows a similar arrangement, which can be employed for electroless plating. Here, elements that are in common with the embodiment of FIG. 1 are identified with the same reference numbers. In this case, the anode basket has been removed and is absent from the chamber 30. Also, the cathode ring 66 is not employed, and is not illustrated in this view. The fluid used in this case would be an electroless plating system, and the consumed components of the system would be replenished in equipment that is situated between the drain 42 and the sparger 24. Otherwise, the plating cell is mechanically the same as the embodiment of FIG. 2. Agitation and homogeneity are accomplished using the rotary blade 50 and the megasonic generator 70, as appropriate to a given application.

In the above-described embodiment, the plating cells are set up for a vertically disposed substrate 22. However, the holder and substrate can favorably be tilted at a back angle, that is, with the axis of the substrate door and substrate facing slightly upwards. As can be seen, it is possible to use substantially identical cells for either an electroless plating step or for a galvanic plating step. It is also possible to employ the cells of this embodiment for other intermediate or preparatory steps, such as a megasonic wash/rinse, a chemical etch, etc.

While the invention has been described with reference to a preferred embodiment, it should be recognized that the invention is not limited to that precise embodiment, or to the variations herein described. Rather, many modifications and variations would present themselves to persons skilled in the art without departing from the scope and spirit of the invention, as defined in the appended claims.

I claim:

1. In a wet process arrangement for wet process treatment of a substrate in which a cell contains a solution in which said substrate is immersed; sparger means in the plating cell adapted to introduce the solution into the cell; spillover means on said cell permits the solution to spill over from the cell into a fluid return that is adapted to carry away the solution from the cell; carrier means hold the substrate in the cell below the spillover means; fluid conditioning means coupled between the return and the sparger means remove any particulate matter from said solution, condition the solution, and return the solution through a conduit to said sparger means; the improvement wherein said carrier means is disposed on a sealable door in said cell and which sealably seats onto an opening in a side wall of said cell, and which includes means for moving said door between a horizontal open position and a vertical closed position.

2. A wet process arrangement according to claim 1, wherein said door includes a hinge means at a lower side thereof defining said open position as a horizontal position and the closed position as a vertical position.

3. A wet process arrangement according to claim 1, wherein a controllable drain in said cell is openable to drain the solution from said cell so that the same is at a level below said door opening when said door is opened, and which is closed to permit the cell to be flooded to the level of said spillover means when the door is in its closed position.

4. A wet process arrangement according to claim 1, wherein said plating cell is adapted for plating said substrate with a metal layer, employing an electroless plating system as said plating solution.

5. A wet process arrangement according to claim 1, wherein said plating cell is adapted for galvanic plating said of substrate with a metal layer, employing an electrolyic solution, and wherein said cell includes a conductive cathode ring disposed at the periphery of said door opening for electrically contacting said substrate when said door is in its closed position.

6. A wet process arrangement according to claim 5, wherein said cathode ring includes a thin metal thieving ring that extends radially into contact with the substrate.

7. A wet process arrangement according to claim 1, wherein megasonic transducer means are disposed in acoustic communication with said cell for applying to the solution in said cell acoustic energy at a megasonic frequency.

* * * * *